US005762272A

United States Patent [19]

Tani et al.

[11] Patent Number: 5,762,272

[45] Date of Patent: Jun. 9, 1998

[54] FLUID INJECTION NOZZLE

[75] Inventors: Yasuhide Tani; Yukio Mori, both of Nagoya, Japan

[73] Assignee: Nippondenso Co., Ltd., Kariya, Japan

[21] Appl. No.: 635,702

[22] Filed: Apr. 22, 1996

[30] Foreign Application Priority Data

Apr. 27, 1995 [JP] Japan ..... 7-104241
Mar. 19, 1996 [JP] Japan ..... 8-062941

[51] Int. Cl.[6] ..... B05B 1/30

[52] U.S. Cl. ..... 239/543; 239/552; 239/585.4; 239/596

[58] Field of Search ..... 239/533.1–533.4, 239/533.7–533.9, 533.11, 533.12, 533.14, 583, 584, 585.1, 590.3, 590.5, 596, 585.4, 543, 552

[56] References Cited

U.S. PATENT DOCUMENTS 5,044,562 9/1991 Rogers et al. ..... 239/543
5,129,381 7/1992 Nakajima ..... 239/533.2
5,273,215 12/1993 Hans et al. ..... 239/533.2
5,383,607 1/1995 Heyse et al. ..... 239/585.4
5,492,277 2/1996 Tani et al. ..... 239/585.5

FOREIGN PATENT DOCUMENTS 870849 3/1942 France .
7-317628 9/1995 Japan .

OTHER PUBLICATIONS

Patent Abstracts of Japan, vol. 016, No. 239 (M01258), 2 Jun. 1992 & JP 04 050464 A (Japan Electron Control Syst Co Ltd), 19 Feb. 1992.

*Primary Examiner*—Andres Kashnikow
*Assistant Examiner*—Lisa Ann Douglas
*Attorney, Agent, or Firm*—Nixon & Vanderhye P.C.

[57] ABSTRACT

A fuel injection nozzle is configured and dimensional with a flat flow passage just above the outlet orifice(s). When the abutting portion of a needle valve moves away from the valve seat, fuel flows are directed uniformly toward the orifice from around its periphery so as to collide with each other just above each orifice inlet. Atomized fuel is then injected to the engine from the orifice. The internal energy of the fuel flows can more effectively be utilized in the collisions to more finely atomize the fuel and to maintain the ability to provide a highly direction output injection spray.

27 Claims, 7 Drawing Sheets

※SMD = Sauter Mean Diameter

FLUID INJECTION NOZZLE

CROSS REFERENCE TO THE RELATED APPLICATIONS

This application is based on and claims priority of Japanese Patent Application Nos. Hei. 7-104241 filed on Apr. 27, 1995 and Hei. 8-62941 filed on Mar. 19, 1996, which are incorporated herein by reference.

BACKGROUND OF THE INVENTION

1. Field of the Invention:

The present invention relates to a fluid injection nozzle, and more particularly for example, to an injection nozzle of a fuel injection valve for injecting and supplying fuel into an internal combustion engine for an automobile.

2. Description of Related Art:

In prior art fuel injection valves atomization of fuel (into fine fuel particles to be injected from an injection hole is important to assist in of reduction of fuel consumption, improvement of exhaust emission, and achievement of a stable operating characteristic for the internal combustion engine. As a method for facilitating atomization of injected fuel, auxiliary atomizing means such as air collision against the injected fuel and heating around the injection hole or the like can be provided, although there is a problem in that these atomizing means are expensive.

On the other hand, various methods for facilitating atomization propose providing an orifice plate formed with small holes at the tip end of the fuel injection valve.

For example, as disclosed in the specification of U.S. Pat. No. 5,383,607, concave portions are formed at the needle tip end. Under such a configuration, although the auxiliary fine particle forming means could be eliminated, a flow or eddy of fuel might be generated along the concave portions at the tip end until the fuel reached the small holes in a direction opposite to the injection flowing direction, thus preventing smooth fuel flow and loss of internal fuel energy so that sufficient atomization cannot be obtained.

Also, in the above specification, the needle tip end is made flat and perpendicular to the needle axis.

However, according to the above structure, since the fuel flows axially while expanding between the needle tip end surface and the orifice plate, its internal energy is lost and sufficient atomization cannot be attained.

SUMMARY OF THE INVENTION

The present invention provides a fluid injection nozzle for atomizing fuel with a simple structure using disturbance of the fuel caused by fuel flow collision just before injection which has a good influence on fuel atomization.

According to an exemplary embodiment of the present invention, the pitch DH between orifices at an inlet surface the orifice plate (hereinafter called a downstream direction control plate) and the seat diameter DS have a relationship $2<DS/DH<4$. When the needle valve adopted is moved away from the valve seat, fluid flows into a spacing chamber defined by the surface of the needle tip end, the inner wall surface of the valve body, and the inlet surface of the orifice plate. Then, the main fuel flow direction is changed by the orifice plate. Flow is U-returned back with flow directed toward the orifice and an opposed flow at the center of the orifice plate while passing between the orifices. As a result, flows directed toward the orifice can be uniformly produced. Also there is a relation between the distance "h" in a needle axial direction (and the diameter "d" of the orifice) when the needle valve is open between the tip end surface disposed at the position opposing against the orifice and formed at the needle tip end and the orifice plate, of $h<1.5$ d between the distance "He" ranging from the seat portion to the orifice plate inlet surface and the orifice diameter "d", $H<3d$ so that a fluid flow passage between the tip end surface and the flow direction control plate can be made flat. A flow passing along the flow direction control plate can be produced and a concurrent collision of fuel flows just above the orifice can be induced.

Accordingly, atomization of the fluid injected from the orifice plate is facilitated due to the disturbance caused by the collision and fuel atomization having a directional characteristic can still be obtained.

BRIEF DESCRIPTION OF THE DRAWINGS

Additional objects and advantages of the present invention will be more readily apparent from the following detailed description of the preferred embodiments thereof when taken along together with the accompanying drawings in which.

DETAILED DESCRIPTION OF PREFERRED EMBODIMENTS

Figure 1:
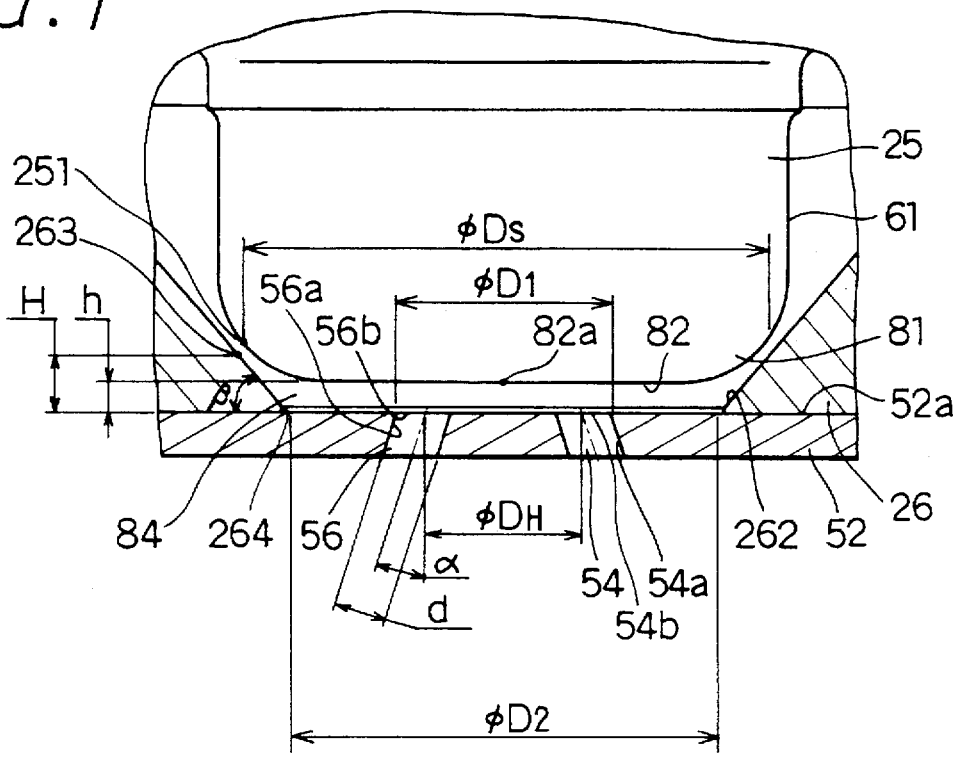
FIG. 1 is an enlarged cross sectional view showing an injection nozzle part of a fuel injection valve of a first embodiment of the present invention.

Referring now to the drawings, a preferred embodiment of the present invention will be described as follows.

A first embodiment in which the present invention is applied to a fuel injection valve of a fuel supplying device of a gasoline engine is described with reference to FIGS. 1 to 7.

Figure 2:
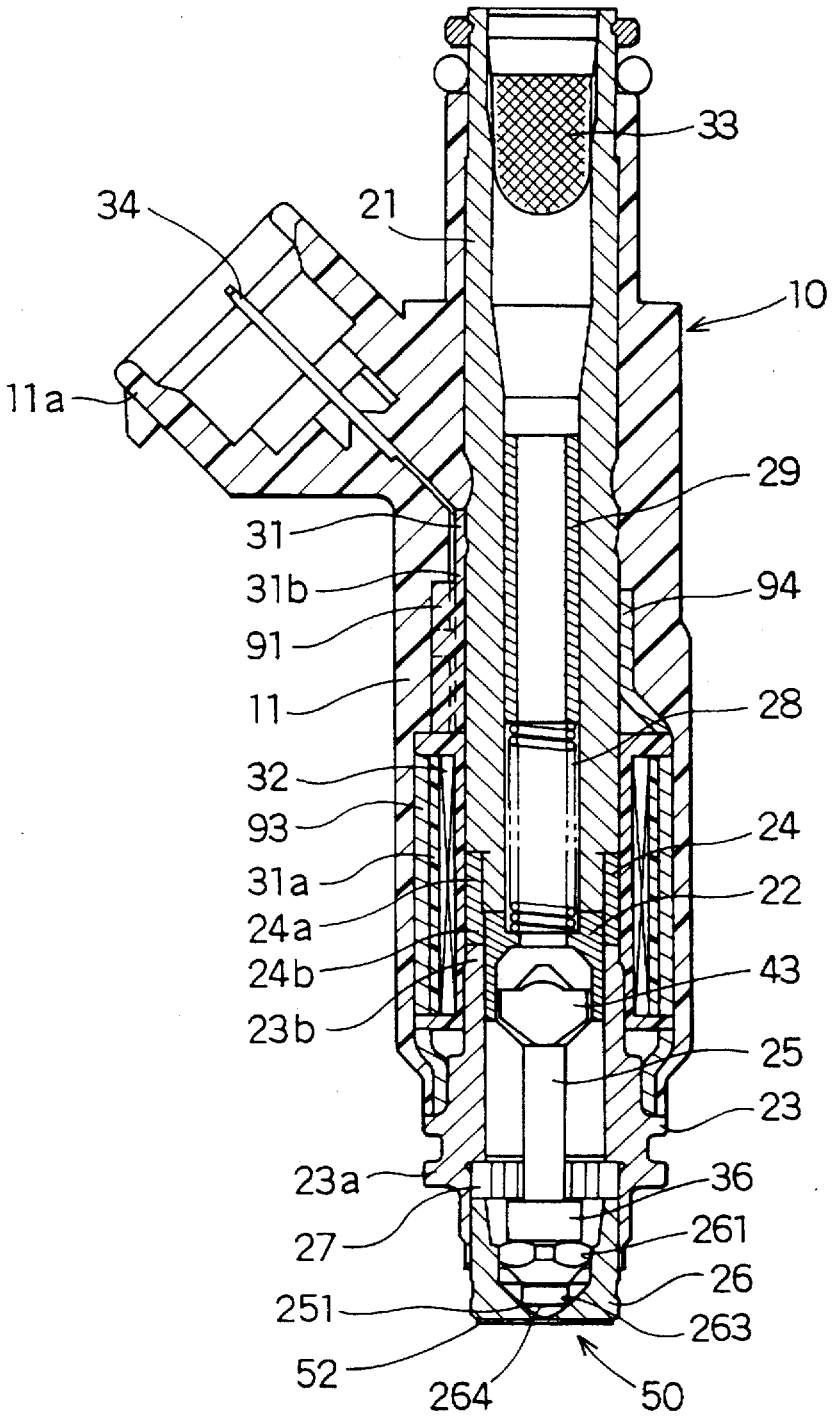
FIG. 2 is a longitudinal cross-sectional showing the fuel injection valve of the first embodiment of the present invention.

At first, referring now to FIG. 2, a fuel injection valve as a fluid injection nozzle will be described. As shown in FIG. 2, a stationary core 21, a spool 91, an electromagnetic coil 32, a coil mold 31 and metallic plates 93, 94 for forming a magnetic path are integrally formed inside a resin housing mold 11 for a fuel injection valve 10 as a fluid injection nozzle.

The stationary core 21 is made of ferromagnetic material and this iron core is arranged within housing mold 11 to protrude out of an upper portion of coil mold 31. To an inner wall of the stationary core 21 is fixed an adjusting pipe 29. The electromagnetic coil 32 is wound around an outer circumference of a resin spool 91 and then coil mold 31 made of resin is molded at an outer circumference of the spool 91 and an outer circumference of electromagnetic coil 32, which is surrounded by the coil mold 31. The coil mold 31 is comprised of a cylindrical cylinder portion 31*a* for protecting electromagnetic coil 32, and a protruding portion 31*b* for protecting a lead wire led out of the electromagnetic coil 32 and protruding upward from the cylindrical portion 31*a* for holding terminal 34 to be described later. Then, spool 91 and electromagnetic coil 32 are installed at the outer circumference of stationary core 21 while being integrally assembled with coil mold 31.

Each upper end of the two metallic plates 93 and 94 contacts an outer circumference of stationary core 21 and each lower end contacts an outer circumference of a magnetic pipe 23 so as to form a magnetic path for allowing magnetic flux to flow when the electromagnetic coil 32 is electrically energized. These plates 93 and 94 cover the outer circumference of the cylindrical portion 31*a* in such a manner that cylindrical portion 31*a* is held from both sides. The electromagnetic coil 32 is protected by the two metallic plates 93 and 94.

Above housing mold 11 is arranged a connector portion 11*a* protruding out of an outer wall of the housing mold 11. Then, terminal 34 electrically connected to electromagnetic coil 32 is embeded in connector portion 11*a* and coil mold 31. In addition, terminal 34 is connected to an electronic control device (not shown) through a wire harness.

One end of a compression coil spring 28 abuts an upper end surface of a needle 25 welded and fixed to a movable core 22, and the other end of compression coil spring 28 abuts a bottom portion of adjusting pipe 29. The compression coil spring 28 biases movable core 22 and needle 25 in a downward direction as viewed in FIG. 3 to make a seat portion of needle 25 be seated on valve seat 263 of valve body 26. When an exciting current flows from terminal 34 to electromagnetic coil 32 through a lead wire by an electronic control device (not shown), needle 25 and movable core 22 are retracted toward stationary core 21 against a biasing force of compression coil spring 28.

A non-magnetic pipe 24 is connected to lower portion of stationary core 21. Then, to the lower portion of the stationary core 21 is connected one end 24*a* to partially protrude from the lower end of stationary core 21. In addition, the lower other end 24*b* of non-magnetic pipe 24 is connected to a diameter reduced portion 23*b* of magnetic pipe 23 made of magnetic material and formed in a stepped pipe shape. The other end 24*b* of non-magnetic pipe 24 may act as a guiding portion for movable core 22.

Then, within the inner spaces of non-magnetic pipe 24 and magnetic pipe 23 is arranged movable core 22 made of magnetic material and formed into a cylindrical shape. An outer diameter of the movable core 22 is set to be slightly smaller than an inner diameter of the other end 24*b* of non-magnetic pipe 24, and movable core 22 is slidably supported at non-magnetic pipe 24. The upper end surface of movable core 22 is arranged in opposition to the lower end surface of stationary core 21 so as to form a predetermined clearance.

At the upper portion of needle 25 is formed a connecting portion 43. Then, connecting portion 43 and movable core 22 are welded by laser, and needle 25 and movable core 22 are integrally connected. At the outer circumference of connecting portion 43 are formed two chamfered portions for fuel passages.

Above stationary core 21 is arranged a filter 33 for removing foreign materials such as dust in fuel pressurized and supplied by a fuel pump or the like and flowing into the fuel injection valve 10.

Fuel flowing into stationary core 21 through filter 33 passes from adjusting pipe 29 through a clearance at the two chamfered portions formed at the connecting portion 43 of needle 25 and further passes through a clearance at the four chamfered portions formed between a cylindrical surface 261 of the valve body 26 and a sliding portion 41 of the needle 25, reaches a valve portion comprised of a seat (abutting portion) 251 at the tip end of needle 25 and a valve seat 263 and finally reaches a cylindrical surface 264 forming an injection hole from the valve.

Figure 3:
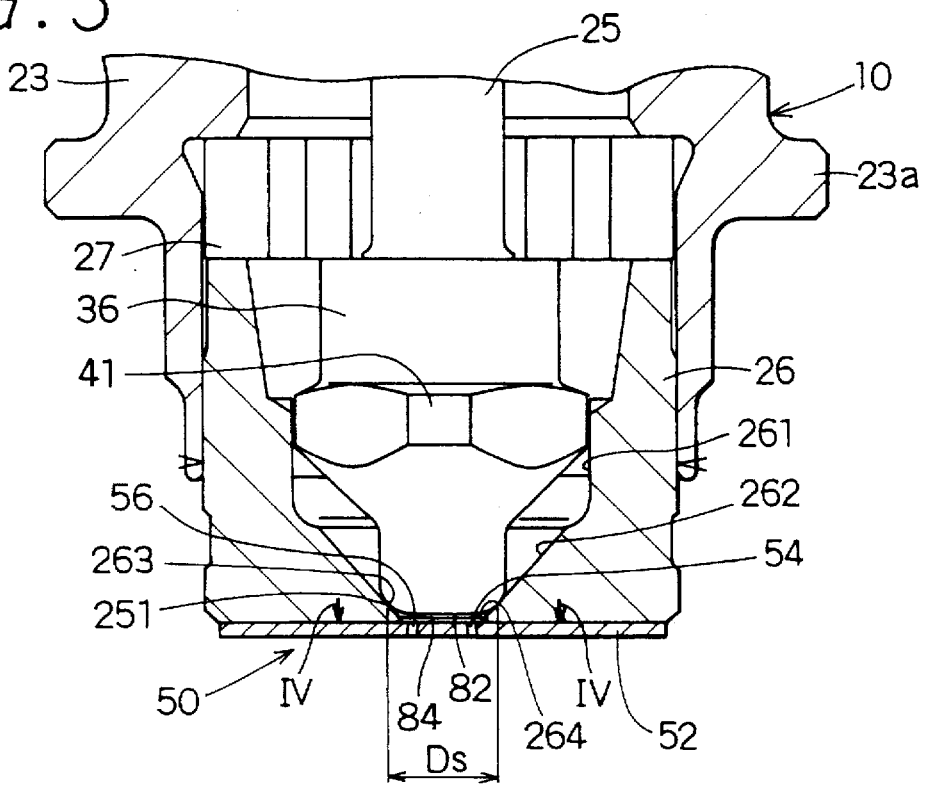
FIG. 3 is a cross-sectional view showing the injection nozzle part of the fuel injection valve of the first embodiment of the present invention.

Referring to FIG. 3, a discharging structure portion 50 of the fuel injection valve 10 is described. The valve body 26 is inserted into a large-diameter portion 23*a* of magnetic pipe 23 through a hollow disk-like spacer 27 and welded thereto by laser. A thickness of spacer 27 is adjusted in such a manner that an air gap between stationary core 21 and movable core 22 shown in FIG. 2 is held with a predetermined value. FIG. 3 shows a closed valve state, wherein an inner wall of the valve body 26 is formed with a cylindrical surface 261 where a sliding portion 41 of the needle 25 slides and with a valve seat 263 on which a cylindrical abutting portion 251 of needle 25 is seated. In the valve closed state, abutting portion 251 and valve seat 263 form a contact point and a set of such contact points is formed in an annular shape with a predetermined seat diameter DS. In addition, a cylindrical surface 264 is formed at a central bottom portion of the valve body 26.

The needle 25 is formed with a flange 36 in opposition to a lower end surface of the spacer 27 accommodated in the inner wall of the large-diameter portion 23*a* of magnetic pipe 23 so as to form a predetermined clearance. This flange 36 is formed at a side of abutting portion 251 formed at the tip end of needle 25 in the entire length of needle 25, and further a lower portion of flange 36 is formed with a sliding portion 41 which can slide on cylindrical surface 26*a* formed at valve body 26. A spacing chamber 84 is formed at a side of the tip end of a flat surface 82 as a tip end surface of needle 25.

Figure 4:
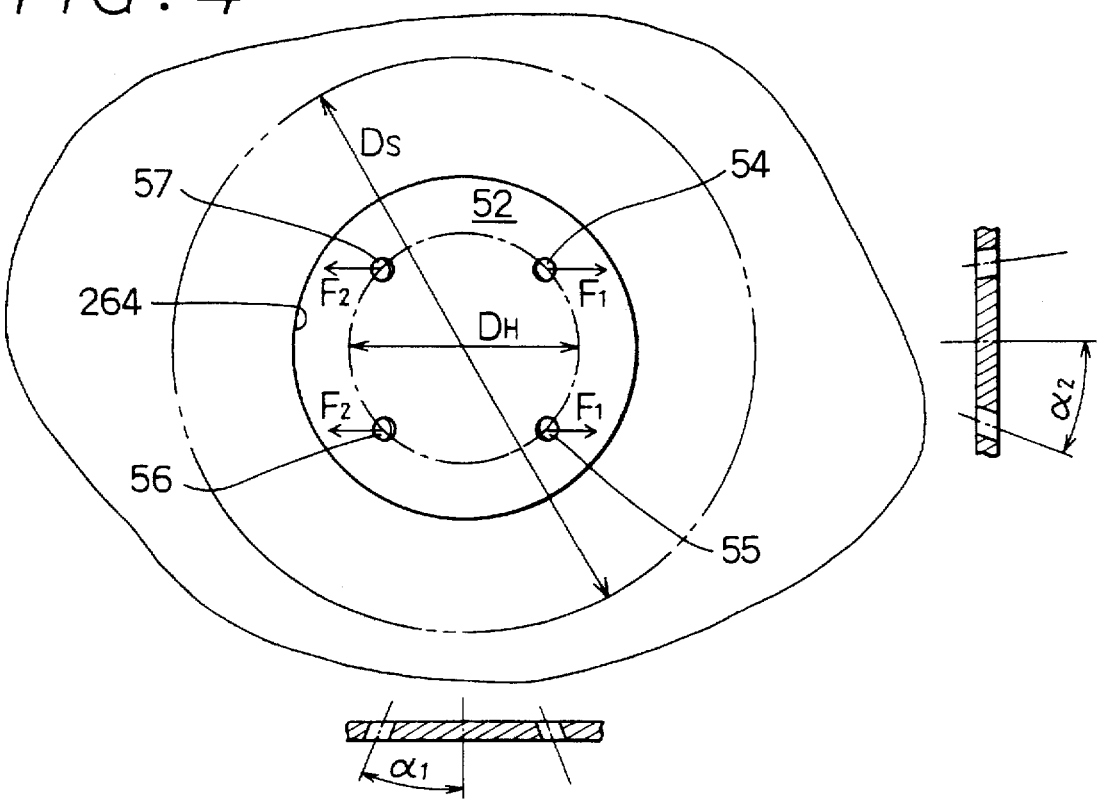
FIG. 4 is a cross-sectional view taken along a line IV—IV of FIG. 3.

The spacing chamber 84 is defined by shapes and positions of needle 25, valve body 26 and orifice plate 52 and a combination of these elements as shown in FIGS. 1, 3 and 4.

Each of these features will be described in sequence as follows.

(1) Needle 25

As shown in FIG. 1, the tip end of the needle 25 is comprised of a solid cylindrical surface 61, an annular curved surface 81 and a flat surface 82.

The annular curved surface 81 connects flat surface 82 at the tip end of the needle 25 with solid cylindrical surface 61 and can abut a conical slant surface 262 of valve body 26 at a portion which is formed in an annular shape having an arcuate cross section. The state shown in FIG. 1 indicates a valve open state, wherein flat surface 82 is formed in parallel to be opposite to an inlet surface 52*a* of orifice plate 52. In addition, an axial distance h of the needle, when the needle valve is open, between the flat surface 82 of the needle 25 and the inlet surface 52*a* of the orifice plate 52 is set to be smaller than 1.5 times the diameter d of each of the orifices 54, 55, 56 and 57 to be described later. In this way, when needle 25 is moved away from the conical slant surface 262 of valve body 26, fuel flows in a clearance between annular curved surface 81 and conical slant surface 262 toward orifice plate 52 and collides with the inlet surface 52*a* of the orifice plate. Then, the fuel flow is curved in a direction toward a spacing chamber partitioned by conical surface 262 at the inlet side of orifice plate 52, flat surface 82 and the inlet surface of orifice plate 52 and flows along an inlet port surface of orifice plate 52. That is, the fuel flows directly toward the orifice, further passes by the orifices and returns back in a U-shaped part at a center of the orifice plate with an opposing flow so that fuel is directed back toward the orifice from the opposite side. Thereby fuel flows collide with each other just above the orifice so as to make an unstable flow state and atomization of the fuel is facilitated.

That is, since the aforesaid distance h and 1.5 times of the aforesaid diameter d are set to have a relation of $h<1.5d$, it is possible for fuel to flow in a narrow clearance between the flat surface 82 and the inlet surface of the orifice plate 52 and thus to induce a collision of the flows with each other in directions perpendicular to the orifice. In this way, it is possible to increase colliding energy of fuel flows with respect to each other and to facilitate the atomization of the fuel.

(2) Valve Body 26

The valve body 26 is comprised of a cylindrical surface 261, a conical slant surface 262 as an inclined surface of the inner wall surface of which diameter is reduced toward a flowing direction of fluid and a cylindrical surface 264 forming a cylindrical hole, wherein boundary lines of each of these surfaces 261, 262 and 264 are circular. A valve seat 263 formed at the conical slant surface 262 is placed at a position where the abutting portion 251 of the needle 25 can abut. A distance H between valve seat 263 and orifice plate 52 is set to have a relation of $H<3d$ with respect to the diameter d of the orifice. That is, the valve seat acting as the inlet for fuel to the spacing chamber is disposed at a place near the orifice plate.

In this way, when needle 25 and valve body 26 are spaced apart, it is possible for fuel flowing between abutting portion 251 and valve seat 263 into the spacing chamber along the conical slant surface 262 to flow along the inlet surface of the orifice plate.

The cylindrical surface 264 is formed between needle 25 and orifice plate 52 at the inlet side of orifice plate 52 in such a range as not to have an influence on main flow.

(3) Orifice Plate 52

The orifice plate 52 acting as an orifice plate for controlling flow directions for atomization is made of stainless steel and connected to a tip end of valve body 26 as shown in FIGS. 3 and 4 by welding such as welding at an entire circumference. This orifice plate 52 has orifices 54, 55, 56 and 57 having four equal diameters ød in a direction of plate thickness.

(i) Inclination angle of the orifice

As shown in FIG. 4, there are four orifices 54, 55, 56 and 57, and each of these orifices 54, 55, 56 and 57 is formed in a straight cylindrical shape, and a central axis of the cylinder and the orifice side walls 52*a*, 55*a*, 56*a* and 57*a* are inclined only by the inclination angles $\alpha 1$, $\alpha 2$ in a direction further from the center than the plate thickness direction as shown in FIG. 4. Fuel passing through the orifices 54, 55, 56 and 57 is accurately injected along the inclination angles $\alpha 1$, $\alpha 2$. Herein, $\alpha 1$ in this case is defined as an inclination angle as viewed from the orifices 55, 56 toward the orifices 54, 57 and $\alpha 2$ is defined as an inclination angle as viewed from the orifices 54, 55 toward the orifices 57, 56, respectively.

Figure 5:
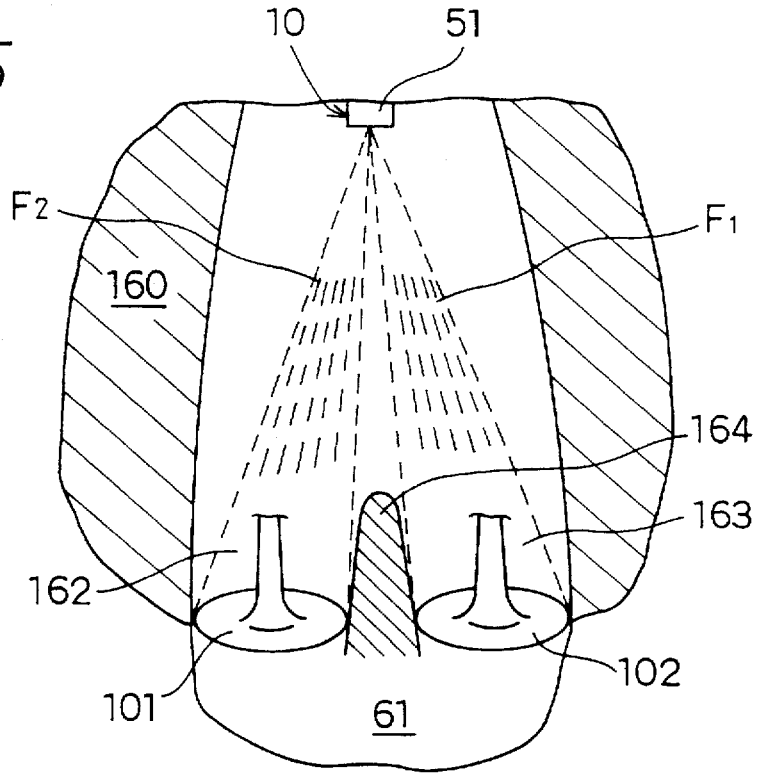
FIG. 5 is an illustrative view showing a fuel injection state of a bi-directional injection system.

This embodiment discloses double-direction atomization. For example, as illustrated in FIGS. 4 and 5 and as described later, a fuel flow F1 is injected from the orifices 54 and 55 toward the bevel portion of one intake valve 102 and a fuel flow F2 is injected from the orifices 57 and 56 toward the bevel portion of the other intake valve 101. The inclination angles $\alpha 1$, $\alpha 2$ of the orifices 54, 55, 56 and 57 have preferably a range of $10 \leqq \alpha 1, \alpha 2 \leqq 40$ (°) and the values of $\alpha 1$, $\alpha 2$ are properly set in compliance with the specification of the engine.

(ii) position of the orifice

As shown in FIG. 1, each of the orifices 54, 55, 56 and 57 is set such that a pitch of each of the orifices at the inlet surface of the orifice plate 52 is øDH and all the opening surfaces 54*b*, 55*b*, 56*b* and 57*b* for the spacing chamber are positioned within an imaginary envelope (with a diameter of (øD2) formed by a crossing line between an extended plane of the conical slant surface 262 of the valve body and an inlet surface of the orifice plate 52. That is, there is a relation of øD1<øD2 between the diameters of øD1 end øD2 of the envelopes of four orifices. In addition, the diameter øDs of the needle seat and the inter-orifice pitch øDH are set to have a relation of $2<DS/DH<4$ Accordingly, in the case that needle 25 and valve body 26 are spaced apart from each other, fuel flowing between abutting portion 251 and valve seat 263 into the spacing chamber flows along conical slant surface 262; thereafter its flowing direction is changed by inlet surface 52*a* of imaginary envelope of the orifice plate 52 and then the fuel flows by a predetermined distance between the inlet port 52*a* of orifice plate 52 and flat surface 82.

Accordingly, the main flow of the fuel can be efficiently atomized without flowing directly into the orifices 54, 55, 56 and 57.

In addition, in view of the aforesaid relationships, intensity of the fuel flow can be equalized with respect to its flowing direction for each of the orifices 54, 55, 56 and 57, respectively. As to a reason for this effect, the present inventors have confirmed it through experiment of visualization, which is described through the first comparison example in reference to FIG. 9. In this first comparison example, the value of DS/DH is set to have a range which is larger than a value of 4 or lower of a numerical limitation range of the present invention.

Figure 9:
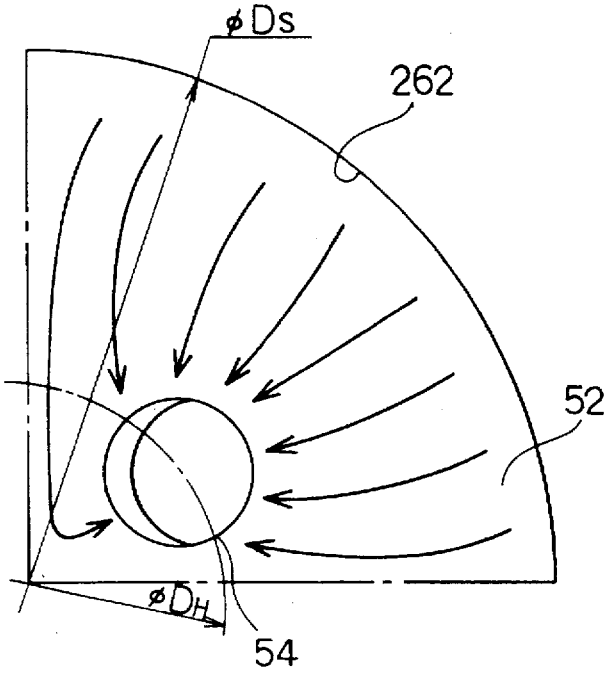
FIG. 9 is a schematic figure showing a flow of fluid in a first comparison example.

In FIG. 9 is illustrated a flow of fuel before passing through the orifice of the second comparison example in which four orifices are arranged with respect to the center of the disc-like orifice plate 52 in a relation of DS/DH=4.4 inter-orifice pitch DH=ø0.7 and a seat diameter of the needle is defined as DS=ø3.1. A part of the flow directed from the outer circumference of the orifice plate is bent at its center and another portion directly flows to the orifice. In this case, the orifice pitch DH is small with respect to the needle seat diameter DS, i.e. four orifices are formed concentrically only at the center portion of the needle, so that the flow directed toward the orifice after being bent at the center of the plate is weaker than that directed from the outer circumference of the orifice plate to the orifice, and therefore, a uniform collision cannot be obtained.

To the contrary, in the case that the four orifices are arranged to have a relation of $2<DS/DH<4$ as in the first embodiment, the four orifices are formed at dispersed locations spaced apart from the center of the needle, so that a difference in intensity between the flow directed toward the orifices after being bent at the center and the flow directed from the outer circumference of the orifice plate to the orifices directly can be reduced and a more uniform flow collision can be obtained.

(iii) Arrangement of the Orifices

In addition, each of the four orifices 54, 55, 56 and 57 is arranged at each of the peak points of a square. In this way, it is possible for the fuel to pass smoothly from the spacing chamber through the orifice and to be injected therefrom. The present inventors have confirmed the reason for it through a visualization experiment, which is described in reference to FIGS. 10 and 4.

Figure 10:
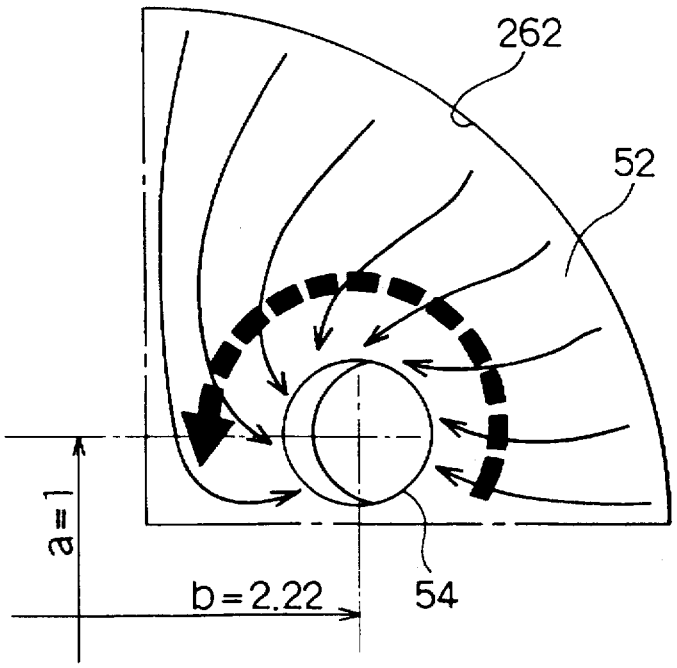
FIG. 10 is a schematic figure showing a flow of fluid in a second comparison example.

In FIG. 10 is illustrated a flow of fuel before passing through the orifices of the second comparison example (in this second comparison example, it is set to be a larger range than that of the numerical limitation range of the present invention of $0.9<b/a<1.1$) in which four orifices are arranged at peak points of a rectangle with its center being placed at a center of a disc-like orifice plate, its one side length a being 1 and a length "b" of the adjacent side being 2.22 (a ratio between a longitudinal side and a lateral side being 2.22). FIG. 10 shows one of the four segments in which the orifice plate is equally divided into the four segments. A flow directed from the outer circumference of the orifice plate toward its center is partially U-turned back by a counter flow at its center and toward the orifice and further partially flows directly toward the orifice. In this way, the flow of fuel directed from the outer circumference of the orifice plate toward the orifices as shown in FIG. 10 has a pitch differing from that of the adjacent orifice. Accordingly, an amount of flow in a line directed toward each of the orifices may produce an eccentric flow in reference to a flowing direction, thus reducing a uniform flow and may produce an eddy flow in a counter-clockwise direction due to unbalanced fuel flow.

To the contrary, in the case that the four peak points of a square with $b/a=1$ (a vertical and lateral ratio of 1.00) have four orifices arranged as in the first embodiment shown in FIG. 4, it is possible to reduce an occurrence of surplus eddy currents in the fuel flowing into the orifices and thus it is possible for the fuel flows to strike each other just above the orifices.

That is, in the first embodiment, the orifices are placed at the peak points of the square and arranged so that a relation of $2<DS/DH<4$ can be obtained.

Figure 11:
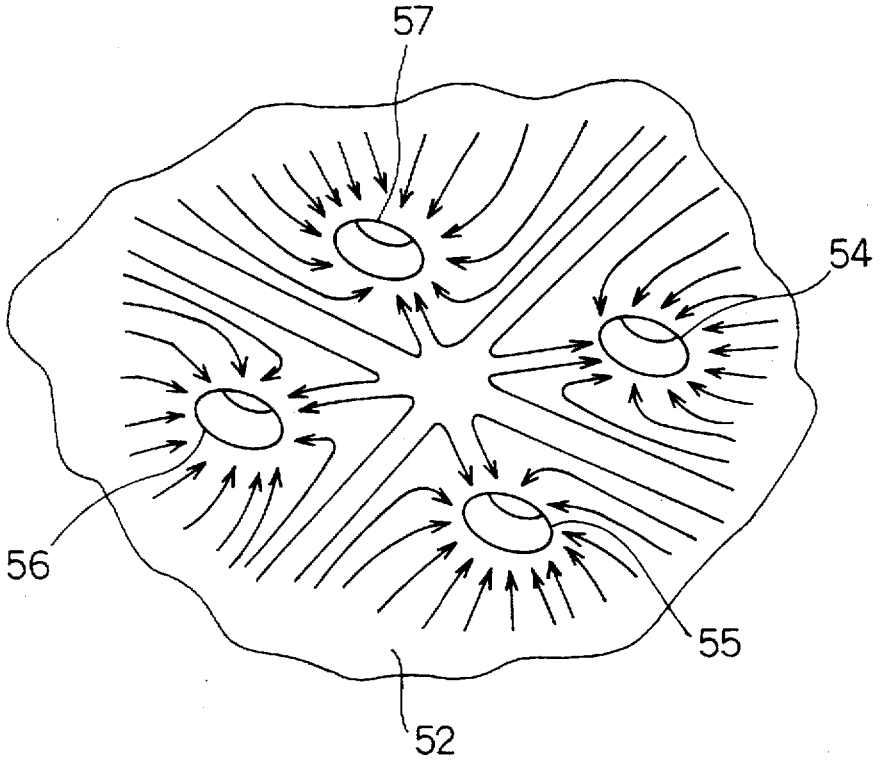
FIG. 11 is a schematic figure showing a flow of fluid in both the first embodiment and the second embodiment of the present invention.

In FIG. 11 is shown a state of fuel flow at that time. The flow of fuel flowing into the orifices flows toward the center of the orifices without producing any eddy current around the orifices. In addition, it is possible to reduce the difference between the flow intensity flowing into the orifices after being U-turned with being opposing flows at the center of the orifice plate and the flow intensity flowing from the outer circumference of the orifice plate directly to the orifices (isotropic flow) so as to collide the flows with each other more equally at the center of orifice inlet. In this way, a more efficient utilization of internal fuel energy can be obtained as a fuel disturbance caused by flow collisions, and therefore, an improved atomization can be realized.

In addition, since more uniform collision of the flows can be obtained at the center of the orifice inlets, atomization having a superior directional characteristic can be obtained along a slant of the entire circumference of the orifice side wall.

FIG. 8 shows a graph in which each of the values of DS/DH, 1.5d–h, and 3d–H is indicated at abscissa and a degree of the atomization is indicated at the ordinate, respectively.

A degree of the atomization is expressed by an SMD (Sauter Mean Diameter, i.e. Sauter mean particle diameter) measurement.

Figure 8A:
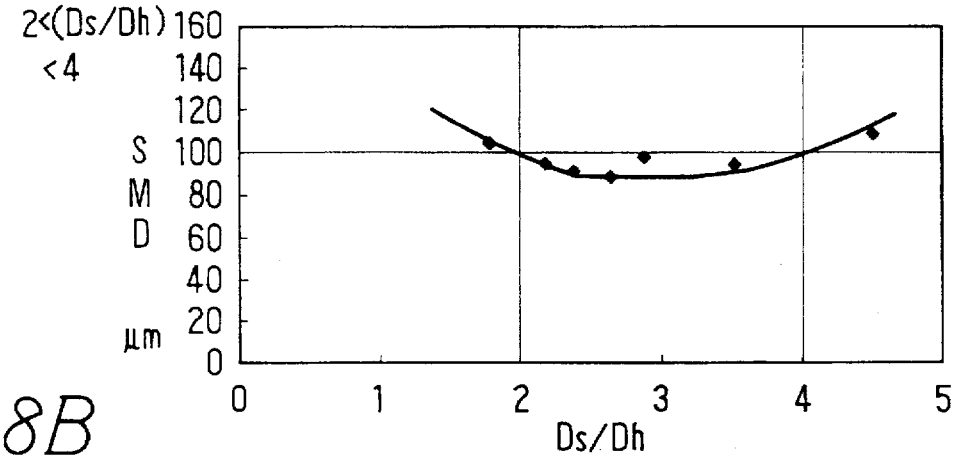
FIGS. 8A-8C are graphs showing an effect of atomized fuel having fine particles of the present invention.
Figure 8B:
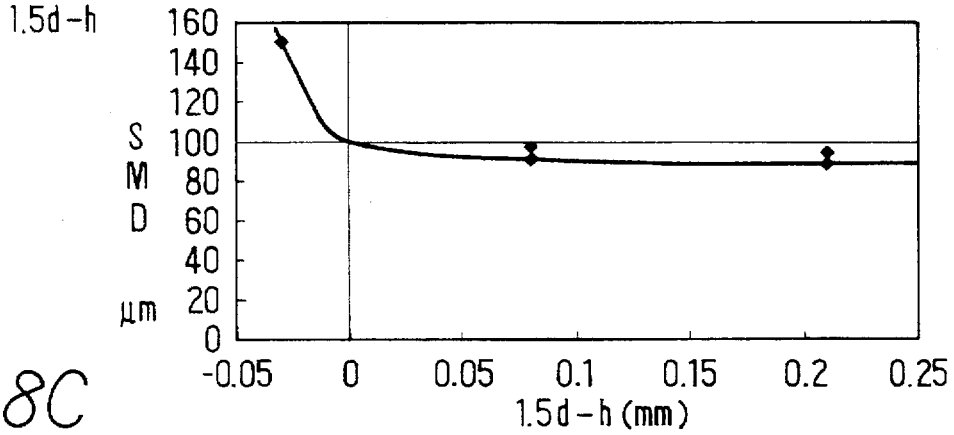
Figure 8C:
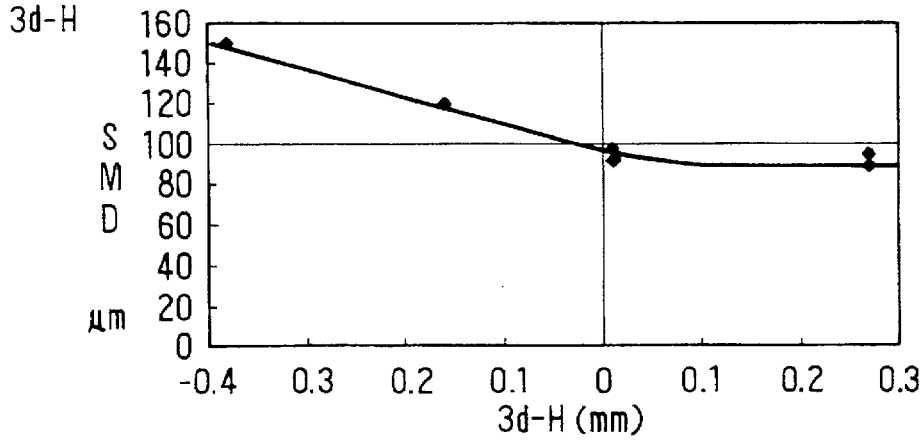

Each of the values of SMD within a range of 2 to 4 of DS/DH in FIG. 8A, a range of more than 0 of a value of 1.5d–h (mm) in FIG. 8B, and a range of more than 0 of 3d–H (mm) in FIG. 8C is 100 μm or less. As is be apparent therefrom, superior atomization can thus be realized.

In the first embodiment, the present invention is applied to the bi-directional injection system as shown in FIG. 5. Such a two-directional injection system is briefly described with reference to FIG. 5. As shown in FIG. 5, intake valves 101, 102, which are opened and closed, are fixed at an intake port 162 and an intake port 163 opens into a combustion chamber 161 of an engine 160. Between intake port 162 and intake port 163 is formed a wall member 164 for partitioning both ports. The fuel injection valve 10 is fixed so that fuel is injected toward the bevel portions of intake valves 101 and 102. According to the first embodiment, in the case that needle 25 and valve body 26 are spaced apart from each other, a part of the fuel flowing from the entire circumference toward a center of the orifice plate is changed in its direction between the center 82*a* of the needle and inlet surface 52*a* of the orifice plate. Then, the fuel flows toward the orifice and collides with fuel flowing from the outer circumference of the orifice plate at the center of the orifice inlet. In addition, since it is possible for the fuel to collide just above the orifice without producing any eddy flow, the internal energy of the fuel can be taken out efficiently as a disturbance caused by collision and efficient atomization can be realized.

In addition, since fuel flow intensity into the orifice after being U-turned at the center of the orifice plate is approximately the same as that of fuel flowing from the outer circumference of the orifice plate directly to the orifice, a more uniform collision can be obtained without producing any eddy flow at the circumference of the orifice, and a more efficient atomization can be realized. Concurrently, the fuel flows collide with each other at the center of the orifices and a more uniform collision of the fuel can be obtained, so that directional characteristics of the atomized fuel are controlled by the side walls 52*a*, 55*a*, 56*a* and 57*a* of the orifice.

A second embodiment of the present invention is described with reference to FIGS. 6 and 7.

Figure 6:
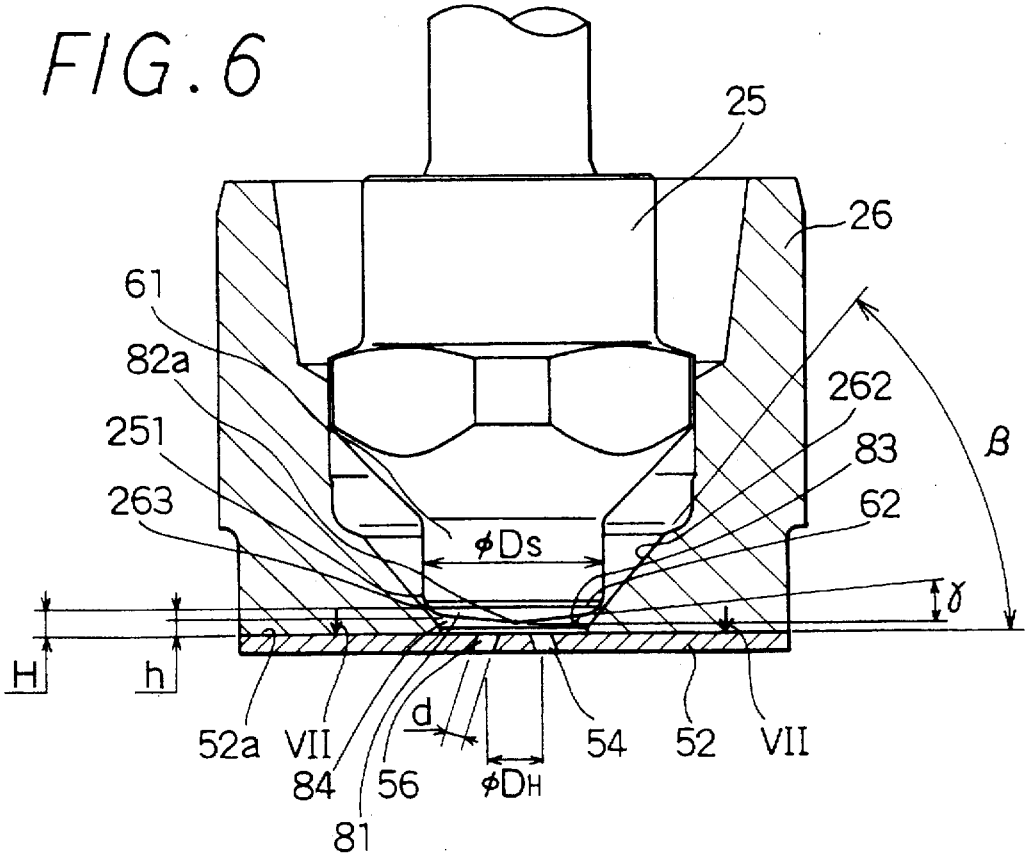
FIG. 6 is a cross-sectional view showing an injection nozzle portion of a fuel injection valve of a second embodiment of the present invention.

In the second embodiment shown in FIG. 6, a solid cylindrical surface 61, a conical slant surface 62 and an annular curved surface 81 are formed at the tip end of the needle, and the tip end is formed with a smooth conical surface 83 as a tip end surface of which diameter is reduced as it is directed toward the center of the needle. Then, a crossing line between the cylindrical portion 61 and conical slant surface 62 of needle 25 forms an abutting portion 251, and distance H between a valve seat 263 of the valve body 26 and inlet surface 52*a* of the orifice plate is H=0.4 mm. A taper angle $\gamma$ of a taper surface is set to $\gamma=5°$, a distance "t" between the center 82*a* of the tip end of the needle and its opposing inlet surface 52*a* of the orifice plate is set to t=0.1 mm; a lifting amount "p" of the needle 25 is set to p=0.06 mm; a diameter "d" of each of the orifices 54, 55, 56 and 57 is set to d=0.25 mm; an inter-orifice pitch DH is set to DH=1.05 mm; inclination angles $\alpha1$, $\alpha2$ of the orifices are set to $\alpha1=15°$ and $\alpha2=5°$; a seat diameter DS is equal to a needle diameter, i.e., DS=3.1 mm; and a slant surface angle $\beta$ of the body valve 26 is set to $\beta=50°$, respectively.

Accordingly, a vertical line distance between the center 82*a* of the tip end of the needle and its opposing orifice plate inlet surface 52*a* when the valve is open, i.e. t+p=0.16 mm is set. Then, the tip end of the needle end is formed with a smooth conical surface in such a manner that its outer circumference has a more enlarged axial needle distance h (a vertical line distance) up to the orifice plate.

Then, the conical surface having as its center the tip end center 82*a* at the tip end surface of the needle is set to satisfy a relation of h<1.5d (=0.375 mm) between a vertical line distance h up to the orifice plate inlet surface when the needle valve is open and the orifice diameter d over its entire region, and a distance H=0.4 mm is smaller than three times of the orifice diameter d=0.25 mm and a relation of H<3d. In addition, the value of DS/DH (=3.1/1.05=2.95) is set between 2 and 4.

Accordingly, also in the second embodiment of the present invention, it is possible for the fuel to flow in the narrow clearance between conical surface 83 and inlet surface 52*a* of orifice plate 52 in the same manner as that of the first embodiment, thereby making it possible to induce collision of flows with each other in directions perpendicular to the orifice. In addition, it is also possible for a flowing-in angle of fuel flowing from between abutting portion 251 and valve seat 263 along conical slant surface 262 into spacing chamber 84 to be closer to the inlet surface of the orifice plate. Further, orifices 54, 55, 56 and 57 are arranged at positions where main major flow of fuel does not directly flow into the orifice, so that the fuel can be efficiently changed into fine particles.

Also in the second embodiment, orifices 54, 55, 56 and 57 have angles α1, α2 which are similar to those of the first embodiment and positions thereof are also located at the same positions as those of the first embodiment, so that no eddy flow is produced around the orifice and the fuels can more uniformly collide with each other at the center of the orifice inlet, resulting in superior atomized fuel with quite superior fine particle formation and directional characteristics (since its detailed description is the same as that of the first embodiment, its description is omitted herein).

Figure 7:
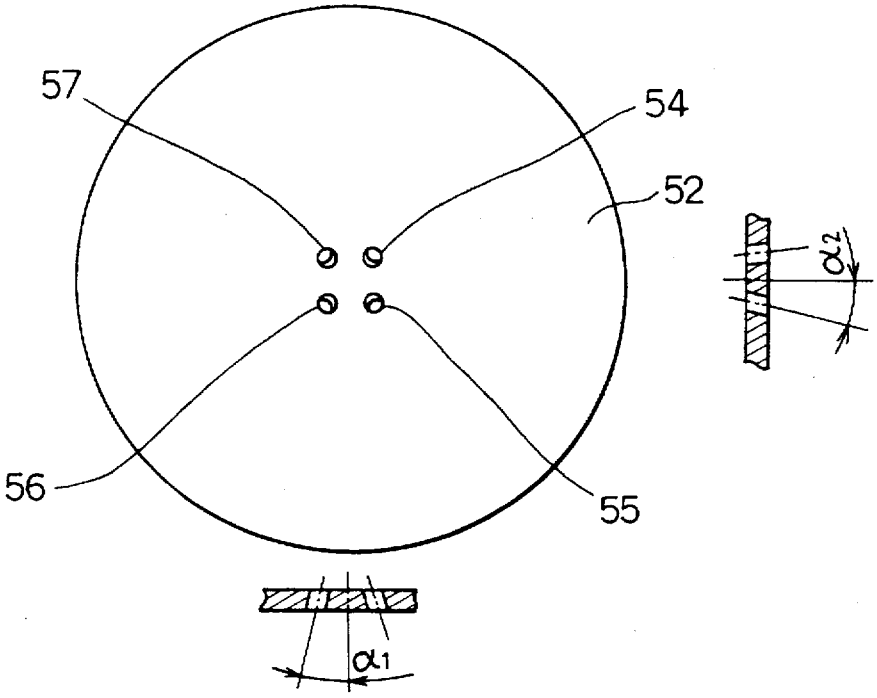
FIG. 7 is a cross-sectional view taken along a line VII—VII of FIG. 6.

In the second embodiment, it is set that DS/DH=2.95 and 3d−H=0.3 (mm)>0 in FIG. 7 and d−h>0 (mm), so that the fuel flow can be set approximately to 90 μm.

In addition, the injection flows passing through orifices 54, 55 and 56, 57 are set such that pitches thereof are enlarged by the aforesaid inclination angles α1, α2 in FIG. 7 with respect to a flowing-out direction of the injection flows. In this way, atomized fuel passing through orifices 54, 55 are injected while maintaining superior fine flow without reducing the number of fine atomized particles 189, by joining of interfering atomized particles. Atomized fuel injected through orifices 56, 57 are the same as well.

In addition, in the second embodiment, since the tip end surface of the needle is formed into a smooth conical surface 83, it is easy to machine the tip end, thus being advantageous in manufacturing.

In the present invention, the number of orifices formed in the orifice plate for controlling the direction of atomization is not limited to any particular number, and it may be of a plurality of numbers, and the inclination direction of each of the holes is not limited to any special angle. In addition, although fuel direction is controlled through the orifice plate, means for controlling the fuel direction is not limited to a plate-like member if the member has a flat surface portion which guides fuel to the orifice after the main flows of fuel collide with each other. Further, a sleeve-like member having partially the plate portion may be applied, and also another direction controlling plate may be applied. In addition, although two-directional injection has been described in the above embodiments, the present invention can also be applied to a uni-directional injection system.

In this case, there is a relation of α1=α2 between the orifice inclination angles α1 and α2 and a uniform flow of fuel is injected through four orifices or a plurality of orifices other than 4.

In addition, in the first and second embodiments, the tip end of the needle is entirely formed except the annular curved surface. However, the range of the tip end surface is not limited thereto, but if the tip end of the needle is disposed at a position opposing against the orifice, it may be formed at a part of the tip end.

In addition, it is preferable that the diameter "d" of the orifice is equal to 0.25 mm or more than that as disclosed in the second embodiment. For example, if the number of orifices is too large and the diameter d is too small, it becomes difficult to keep a clearance between the needle and the orifice plate small and the desired atomization having fine particles may not be easily obtained.

According to the fluid injection nozzle of the present invention, it is possible to obtain a plurality of atomized flows having superior accurate directional characteristic by being changed into fine particles through the flow direction control plate with a simple configuration. In this way, it is possible to provide a fuel injection valve capable of providing superior fuel atomization in which the fuel can be directed toward a bevel portion of the intake valve and easily mixed with air, thus improving exhaust emission and further reducing fuel consumption.

Although the present invention has been fully described in connection with exemplary embodiments thereof with reference to the accompanying drawings, it is to be noted that various changes and modifications will become apparent to those skilled in the art. Such changes and modifications are to be understood as being included within the scope of the present invention as defined in the appended claims.

What is claimed is:

1. A fluid injection nozzle comprising:

a valve body having an inner wall surface for forming a fluid passage therein and a valve seat;

a needle disposed in said fluid passage and having an abutting portion with a predetermined annular seat diameter, said abutting portion being for abutting on or moving away from said valve seat, for intermittently performing a fluid injection; and an orifice plate fixed to a downstream side of said inner wall surface of said valve body and having a plurality of orifices for passing fluid in a plate thickness direction in such a manner that a main flow direction of fluid at the downstream side of said abutting portion is formed within an imaginary envelope line connecting positions crossing at an inlet surface of said orifice plate;

wherein said needle is formed with a downstream tip end thereof inside said abutting portion at a position opposite to at least one of said orifices and said nozzle has the following relationship

2<DS/DH<4, h<1.5d, and

H<3d wherein a diameter of said at least one orifice is "d", a pitch between at least two of said orifices at the inlet port surface of said orifice plate is "DH", said predetermined seat diameter is "DS", a distance ranging from said seat portion to said orifice plate inlet surface is "H", and a vertical line distance ranging from said tip end surface to said orifice plate inlet surface opposite against said tip end surface when said abutting portion is spaced apart from said valve seat is "h".

2. A fluid injection nozzle as in claim 1, wherein said inner wall surface has an inclined surface with a reduced diameter toward a fluid flow direction.

3. A fluid injection nozzle as in claim 2, wherein said inner wall surface is a conically inclined surface.

4. A fluid injection nozzle as in claim 3, wherein said tip end surface is disposed at a center of said downstream side tip end.

5. A fluid injection nozzle as in claim 4, wherein said tip end surface is formed substantially in parallel with said inlet surface of said orifice plate.

6. A fluid injection nozzle as in claim 4, wherein said plurality of orifices are four in number.

7. A fluid injection nozzle as in claim 6, wherein said four orifices are placed at peak point positions of a rectangle and have the following relationship:

$0.9<b/a<1.1$ where one side length of said rectangle is "a" and another adjacent side length is "b".

8. A fluid injection nozzle as in claim 7, wherein said orifice is inclined by a predetermined angle with respect to said plate thickness direction.

9. A fluid injection nozzle as in claim 8, wherein said predetermined angle is in a range of 2° to 40° in a direction spaced apart from the center of said imaginary envelope line.

10. A fluid injection nozzle as in claim 9, wherein a fuel injection flow F1 in one direction is formed by two orifices of said four orifices and a fuel injection flow F2 in another different direction is formed by the other two orifices.

11. A fluid injection nozzle as in claim 10, wherein each of said fuel injection flow F1 and said fuel injection flow F2 is injected toward a different intake valve.

12. A fluid injection nozzle as in claim 9, wherein a single directional fuel injection flow is formed by said four orifices.

13. A fluid injection nozzle as in claim 4, wherein said tip end surface is a smooth conical surface having a diameter which is gradually reduced toward a fluid flowing direction.

14. A fluid injection nozzle as in claim 13, wherein said plurality of orifices are four in number.

15. A fluid injection nozzle as in claim 14, wherein said four orifices are disposed at peak point positions of a square.

16. A fluid injection nozzle as in claim 15, wherein said orifices are inclined by a predetermined angle with respect to a fluid flow direction.

17. A fluid injection nozzle as in claim 16, wherein in that said predetermined angle is in a range of 2° to 40° in a direction moving away from a center of said imaginary envelope line.

18. A fluid injection nozzle as in claim 17, wherein one directional fuel injection flow F1 is formed by two orifices of said four orifices and another directional fuel injection flow F2 is formed by the other two orifices.

19. A fluid injection nozzle as in claim 18, wherein each of said fuel flow F1 and said fuel flow F2 is injected toward a different intake valve.

20. A fluid injection nozzle as in claim 17, wherein uni-directional fuel injection flow is formed by said four orifices.

21. A fluid injection nozzle comprising:

a valve body having an inner wall surface for forming a fluid passage allowing fluid to flow therein and a valve seat;

a needle disposed in said fluid passage and having an abutting portion with a predetermined annular seat diameter, said abutting portion being for abutting on or moving away from said valve seat, for intermittently performing injection of fluid; and an orifice plate fixed to a downstream side of said inner wall surface of said valve body and having a plurality of orifices for passing fluid in a plate thickness direction in such a manner that a main flow direction of fluid at the downstream side of said abutting portion is formed within an imaginary envelope line connecting positions crossing at an inlet surface of said orifice plate;

wherein said needle has said abutting portion at a downstream tip end thereof, said abutting portion having a flat surface in parallel with the inlet surface of said orifice plate; and wherein at least one of said orifices is inclined by a predetermined angle with respect to said plate thickness direction.

22. A fluid injection nozzle as in claim 21, wherein said fluid flowing in said valve body and injected by said nozzle is the same fluid passing through said orifices.

23. A fluid injection nozzle as in claim 22, wherein said predetermined angle is in a range of 2° to 40° in a direction moving away from the center of said imaginary envelope line.

24. A fluid injection nozzle comprising:

a movable valve member and associated valve seat interposed in a fluid flow passage of a nozzle body;

an orifice plate having plural orifices disposed downstream of said valve seat; and a substantially flat fluid flow cavity disposed at the flow inlet side of said orifices and dimensioned with respect to said orifices so as to cause approximately equal oppositely-directed fluid flows within said cavity around the periphery of each orifice inlet thus causing collision of said oppositely directed flows in the vicinity of each orifice inlet.

25. A fluid injection nozzle as in claim 24 wherein said cavity is formed between a flat end surface of the movable valve member and a parallel flat inlet side of said orifice plate when the valve member is moved away from its associated valve seat.

26. A fluid injection nozzle as in claim 24 wherein each orifice has an inclined axis with respect to an inlet surface of the orifice plate.

27. A fluid injection nozzle as in claim 24 wherein said orifices are disposed at the corners of a rectangle having $0.9<b/a<1.1$ where a and b are the side dimensions of the rectangle.

* * * * *